US007117829B2

(12) United States Patent
Haas

(10) Patent No.: US 7,117,829 B2
(45) Date of Patent: Oct. 10, 2006

(54) METHOD AND DEVICE FOR CONTROLLING THE DRIVE UNIT OF A VEHICLE

(75) Inventor: Wolfgang Haas, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/512,592

(22) PCT Filed: Nov. 19, 2002

(86) PCT No.: PCT/DE02/04256

§ 371 (c)(1),
(2), (4) Date: May 26, 2005

(87) PCT Pub. No.: WO03/091561

PCT Pub. Date: Nov. 6, 2003

(65) Prior Publication Data

US 2005/0253455 A1 Nov. 17, 2005

(30) Foreign Application Priority Data

Apr. 23, 2002 (DE) ..... 102 18 014

(51) Int. Cl.
*F01L 1/34* (2006.01)

(52) U.S. Cl. ..... 123/90.15; 701/114

(58) Field of Classification Search ..... 123/188.1, 123/339.1, 90.11, 90.23, 90.15; 701/107, 701/114

See application file for complete search history.

(56) References Cited

U.S. PATENT DOCUMENTS 5,880,568 A * 3/1999 Bederna et al. ..... 318/563
5,992,379 A * 11/1999 Brudigam et al. ..... 123/339.1
6,230,094 B1 5/2001 Kato et al.

FOREIGN PATENT DOCUMENTS

| | | |
|---|---|---|
| DE | 197 23 563 | 12/1998 |
| DE | 197 31 972 | 1/1999 |
| DE | 197 57 334 | 7/1999 |
| EP | 0 788 581 | 8/1997 |

* cited by examiner

*Primary Examiner*—Tony M. Argenbright
*Assistant Examiner*—Hyder Ali
(74) *Attorney, Agent, or Firm*—Kenyon & Kenyon LLP

(57) ABSTRACT

A method and a device for controlling the drive unit of a vehicle are described, which make it possible to suppress faults during controlling. On a first level, at least one first control variable is formed for controlling at least one actuator of the drive unit. On a second level, the correct formation of the at least one first control variable on the first level is verified using at least one selected variable. The at least one first control variable for controlling the at least one actuator is influenced by the second level if the at least one selected variable assumes a predefined value or lies within a predefined range.

12 Claims, 2 Drawing Sheets

METHOD AND DEVICE FOR CONTROLLING THE DRIVE UNIT OF A VEHICLE

FIELD OF THE INVENTION

The present invention is directed to a method and a device for controlling the drive unit of a vehicle.

BACKGROUND INFORMATION

A method and a device for controlling the drive unit of a vehicle are known from European Published Patent Application No. 0 788 581. A computing element is provided which both controls the output of the drive unit and monitors this output control. Furthermore, the computing element has at least two program levels, which do not influence one another, at least outside of a fault case, at least one control variable for controlling the output of the drive unit being formed on a first level in at least one operating state of the vehicle, the correct formation of the at least one control variable on the first level being verified on the second level using selected variables.

SUMMARY OF THE INVENTION

The method and the device according to the present invention for controlling the drive unit have the advantage over the related art that the at least one first control variable for controlling the at least one actuator is influenced by the second level when the at least one selected variable assumes a predefined value or lies within a predefined range. In this way, conditions under which a faulty activation of the at least one actuator will quickly result in safety-critical effects or damage to the overall system or to the drive unit may be taken into account in advance at the time the at least one actuator is activated or controlled. A preventive measure against faults occurring in the control of the at least one actuator is thus implemented on the first level. This prevents a fault from occurring in the activation of the at least one actuator. It is thus unnecessary to respond to a fault that has occurred and the response time required for it is eliminated. As described, this is advantageous in particular for applications in which a faulty activation of the at least one actuator quickly results in safety-critical effects or damage to the drive unit.

It is particularly advantageous for the at least one first control variable to be suppressed during the influencing of the at least one first control variable on the part of the second level. In this way, when the at least one selected variable on the second level is used to detect conditions which result in faulty activation of the at least one actuator, it is possible to block the activation of the at least one actuator by the at least one first control variable on the part of the second level and thus to prevent the occurrence of a fault.

Another advantage results when the at least one first control variable which is influenced by the second level is fed back to the first level. In this way, it is possible to determine on the first level if the at least one first control variable formed is forwarded essentially unchanged to an output stage for activating the at least one actuator or was influenced on leaving the second level. In the second case, it is possible to detect a fault on the first level, and as a consequence of this, to form at least one second control variable for at least partially switching off the output of the drive unit.

It is advantageous if the at least one first control variable is used to control the opening of an intake and/or an exhaust valve of at least one cylinder of the drive unit. A faulty activation of the intake and/or exhaust valve may result in a collision of the intake and/or exhaust valve with the piston of a cylinder. In this case, a fault in the activation may result directly in a safety-critical effect or damage in the cylinder, which may be prevented by the method according to the present invention.

Another advantage is that the at least one selected variable is derived from a crank angle of at least one cylinder of the drive unit. In this way, in the event that the at least one first control variable controls the opening of the intake and/or exhaust valve, it is possible to establish a precise setpoint for those crank angles for which the intake and/or exhaust valve must be closed or not activated for opening in order to prevent a collision with the piston of the cylinder.

DETAILED DESCRIPTION

Figure 1:
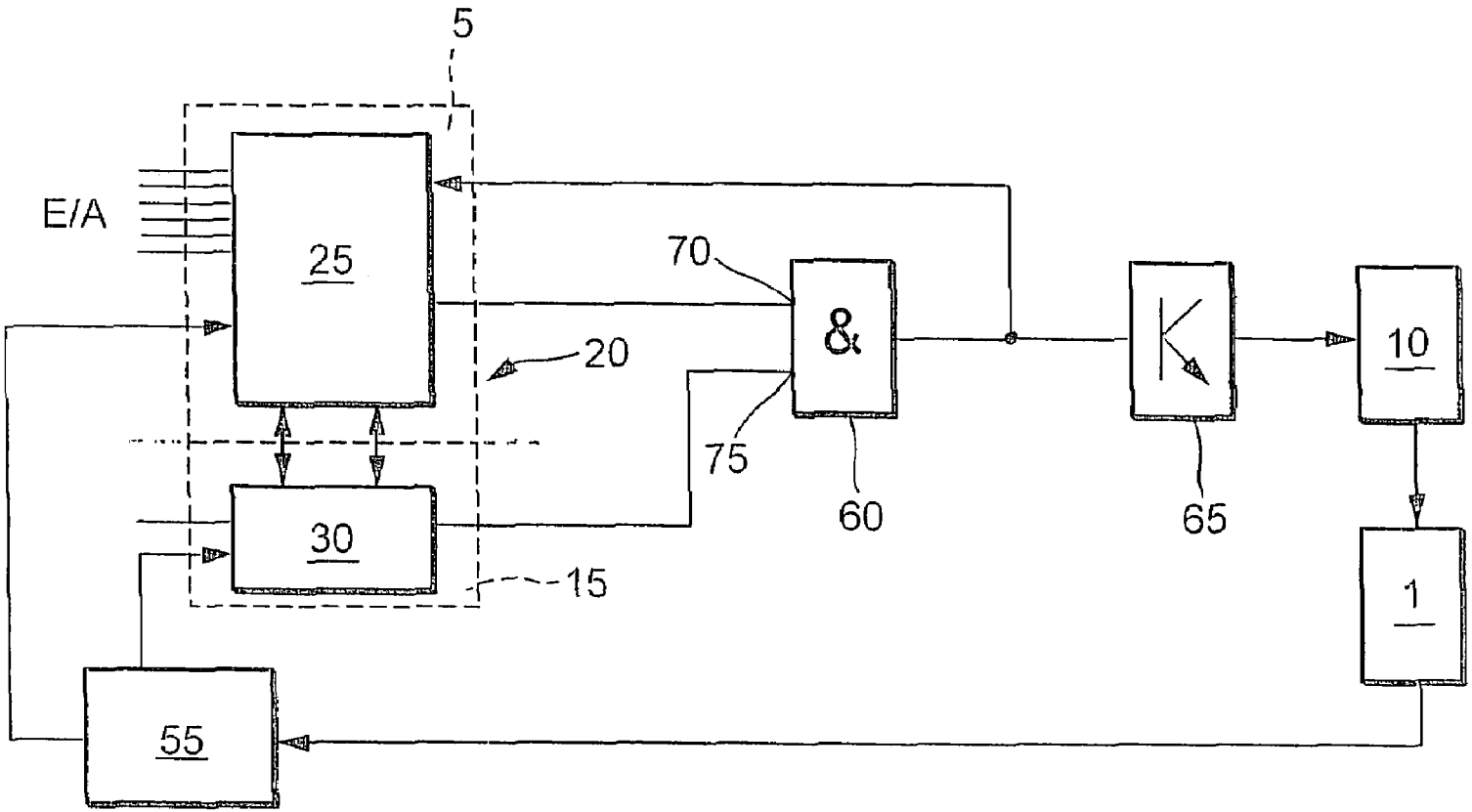
FIG. 1 shows a block diagram of a device according to the present invention, which simultaneously illustrates the sequence of the method according to the present invention.

In FIG. 1, 1 denotes a drive unit of a vehicle, for example an internal combustion engine. Internal combustion engine 1 includes one or a plurality of cylinders, each having an intake valve for the fresh gas supply and an exhaust gas valve for exhaust gas removal. During operation in the particular cylinder, a piston moves, thereby driving a crankshaft. Sensor means 55 detect the present crankshaft angle or crank angle. Sensor means 55 provide a value for the detected present crank angle to a device 20 for controlling internal combustion engine 1, which in the following is also described as a control unit. Control unit 20 includes a first level 5 and a second level 15. In first level 5, means 25 are provided for forming at least one first control variable for controlling at least one actuator 10 of internal combustion engine 1. In second level 15, means 30 are provided for verifying the correct formation of the at least one first control variable in first level 5. The value of the present crank angle is supplied both to means 25 and to means 30. It is possible to assign additional variables, such as the position of an accelerator pedal, the speed setpoint of a cruise control, etc., to means 25, which are also described as a functional unit in the following. Functional unit 25 may use this to derive at least one second control variable for controlling the output of internal combustion engine 1. Via one output stage and one actuator in each case, the at least one second control variable may activate the fuel injection, the ignition, and/or the air supply for at least one cylinder of internal combustion engine 1. Correspondingly, means 30, which in the following are also described as a monitoring unit, may also be fed the input signals of functional unit 25 in order to make it possible to monitor the functionality of functional unit 25. For the formation of the at least one second control signal, functional unit 25 may also be fed operating variables of internal combustion engine 1 and/or of the vehicle, which are detected by measuring devices not shown in FIG. 1. These operating variables are also fed to monitoring unit 30 for the monitoring of functional unit 25.

These operating variables may include, for example, the engine temperature, the ambient air pressure, the position of an electrically operable throttle valve, etc. For monitoring purposes, it is possible for monitoring unit 30 to communicate with functional unit 25 and reset it if necessary in order to control the activation of the internal combustion engine in a fault case. The at least one control variable formed by functional unit 25 is routed to a first input 70 of an AND gate 60. As a function of the received present crank angle, monitoring unit 30 forms an influencing signal of the at least one first control variable. The influencing signal is given to a second input 75 of AND gate 60. It may assume the value zero or one. In the event that the influencing signal assumes the value zero, the signal output by AND gate 60 is also equal to zero. In the event that the influencing signal assumes the value one, the output signal of the AND gate corresponds to the at least one first control variable. The output of AND gate 60 is fed back to functional unit 25 for analysis. It is also supplied to an output stage 65, which activates an actuator 10 for setting the opening degree of the intake and/or exhaust valve of a corresponding cylinder of internal combustion engine 1 as a function of the at least one first control variable. In the event that the output of AND gate 60 assumes the value zero, actuator 10 is prompted via output stage 65 to close the intake and exhaust valve of the corresponding cylinder in order to prevent a collision with the piston of the cylinder.

Figure 2:
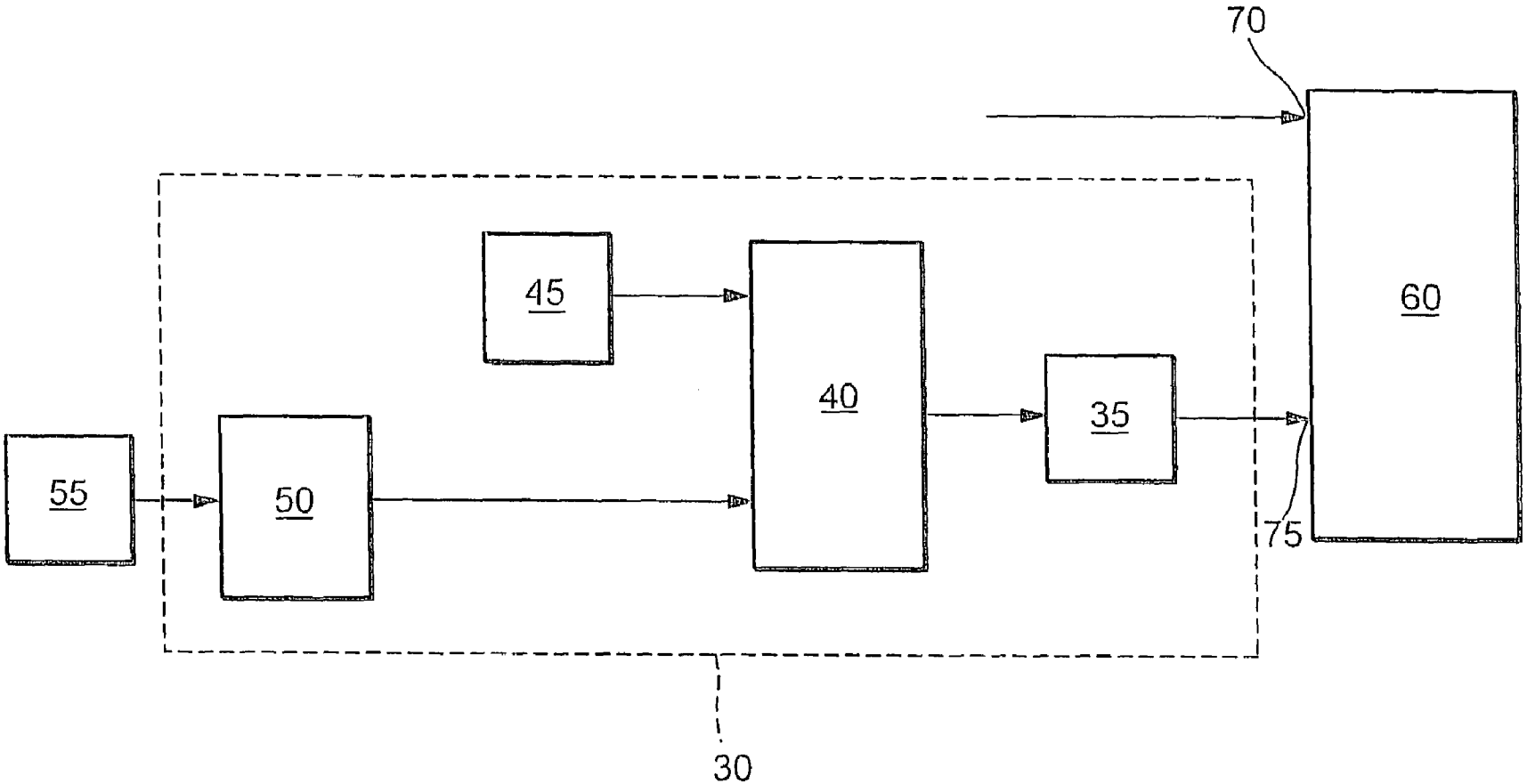
FIG. 2 shows a block diagram of one part of the device according to the present invention for a detailed representation of the sequence of the method according to the present invention.

Monitoring unit 30 is shown in detail in FIG. 2, identical reference numerals denoting the same elements as in FIG. 1. The value output by sensor means 55 for the present crank value is received by receiving means 50 of monitoring unit 30 and sent to comparing means 40. Furthermore, monitoring unit 30 includes setpoint means 45 for predefining a crank angle value or a crank angle range. Setpoint means 45 may be designed as a memory and may also be connected to comparing means 40. Comparing means 40 compare the received present crank angle with the predefined value or range for the crank angle. The comparison result is output by comparing means 40 to influencing means 35 of monitoring unit 30, which form the described influencing signal and output it to input 75 of AND gate 60. If the present value of the crank angle corresponds to the predefined value or is within the predefined range, influencing means 35 output the value zero as an influencing signal to second input 75 of AND gate 60. Otherwise, influencing means 35 output the value one to second input 75 of AND gate 60 as an influencing signal.

The predefined crank angle value or the predefined crank angle range, which is stored in setpoint means 45, may advantageously be selected in such a way that the piston of the corresponding cylinder may collide with an open intake and/or exhaust valve at this crank angle or in this crank angle range.

If comparing means 40 receive via receiving means 50 from sensor means 55 a value for a present crank angle, which corresponds to the predefined value or is within the predefined range, the at least one first control variable is suppressed with the aid of the influencing signal set to zero via AND gate 60 and accordingly an opening of the intake valve and exhaust valve and thus a collision with the piston of the corresponding cylinder is prevented. Otherwise, the activation of actuator 10 including the at least one first control variable formed by functional unit 25 is influenced by monitoring unit 30 and not by the influencing signal so that actuator 10 may be activated via the at least one first control variable.

The feedback of the output signal of AND gate 60 to functional unit 25 makes it possible for functional unit 25 to verify if the at least one first control variable output by it was influenced by monitoring unit 30. If this is the case, functional unit 25 detects a fault case, which is due either to a faulty function of monitoring unit 30, a faulty function of AND gate 60, or a faulty function of functional unit 25. It may then be provided that functional unit 25 forms at least one second control variable for controlling the output of internal combustion engine 1 in such a way that the at least one second control variable at least partially switches off the output of internal combustion engine 1. If, as described, the at least one second control variable controls the fuel injection, the ignition, or the air supply, for example, for at least one cylinder of drive unit 1, the fuel injection for one cylinder or a plurality of cylinders of internal combustion engine 1 may be interrupted for the detected fault case, the ignition for one or a plurality of cylinders of combustion engine 1 may be suspended, and/or the air supply to one or a plurality of the cylinders may be interrupted.

In the event that functional unit 25 detects no fault case, i.e., it determines an agreement of the output signal of AND gate 60 with the emitted at least one first control signal, no such fault correction is initiated and the at least one second control variable is not changed for an at least partial shutoff of the output of internal combustion engine 1.

For the above-described fault case, it may be provided that functional unit 25 suppresses precisely the cylinder or cylinders of internal combustion engine 1 via the at least one second control variable in the manner described above, monitoring unit 30 influencing the at least one first control variable provided for it. In this way, the cylinder or cylinders affected by the particular fault case may be suppressed.

Functional unit 25 functions correctly with respect to the activation of actuator 10 when it forms the at least one control variable, only for such crank angles presently received by sensor means 55 which do not correspond to the predefined crank angle value or do not lie in the predefined crank angle range. To that end, functional unit 25 may include components corresponding to the components of monitoring unit 30 shown in FIG. 2, means other than influencing means 35 being provided to form the at least one first control variable, which, as described, form or do not form the at least one first control variable as a function of the comparison result. Additional operating parameters of internal combustion engine 1 and/or of the vehicle are of course supplied to the means for forming the at least one first control variable, the additional operating parameters being only suggested in FIG. 1 but also being of significance for forming the at least one first control variable.

In addition to the monitoring activity according to the present invention described here, monitoring unit 30 may also monitor functional unit 25 in the manner described in EP 0 788 581 B1 in a system having an electrically actuatable throttle valve, it also being possible for this electrically actuatable throttle valve to be activated by functional unit 25.

Functional unit 25 and monitoring unit 30 may be implemented using various computing units or processors. However, functional unit 25 and monitoring unit 30 may also be implemented in the same computing unit or in the same processor. It may also be provided that at least a part of the functions of monitoring unit 30 is implemented in the computing unit of functional unit 25 and the remaining part in a separate processor or in a separate computing unit.

The method and device according to the present invention may prevent the occurrence of potential faults in the formation of the at least one first control variable by the influencing signal so that it is not necessary to respond only after a fault has occurred and to allow the response time necessary for this to elapse. If a situation is present in which a fault may occur, a predefined value or a predefined range for the crank angle in the example described, monitoring unit 30 may block the activation of corresponding actuator 10 as described. This prevents unacceptable activation of actuator 10 via output stage 65 due to possibly faulty operation of functional unit 25.

In addition, monitoring unit 30 may verify the functionality of functional unit 25 via mutual communication with functional unit 25. This may be done as described in EP 0 788 581 B1. If an error is detected via the communication link between monitoring unit 30 and functional unit 25, activation of actuator 10 via output stage 65 may be blocked irrespective of the crank angle values delivered by sensor means 55, as is also evident from EP 0 788 581 B1. With respect to the described method according to the present invention, monitoring unit 30 finally determines at what points in time functional unit 25 may activate actuator 10 via output stage 65. The amount of computing power required for this is comparatively low in the event that monitoring unit 30 also, as described above, monitors the output control of internal combustion engine 1 via functional unit 25.

Monitoring unit 30 thus verifies the correct formation of the at least one first control variable via functional unit 25 starting from the received value for the present crank angle by interrupting the activation of actuator 10 via output stage 65 using the at least one first control variable in the event that the value of the present crank angle corresponds to the predefined value or is within the predefined range.

The present invention was described by way of example for the activation of an actuator for activating the opening of an intake valve and of an exhaust valve of a cylinder of internal combustion engine 1. Correspondingly, the activation may be performed for each additional cylinder or any actuator of internal combustion engine 1.

The invention claimed is:

1. A method for controlling a drive unit of a vehicle, comprising:

forming on a first level at least one first control variable for controlling at least one actuator of the drive unit;

verifying on a second level and in accordance with at least one selected variable whether the forming of the at least one first control variable is correct; and causing the second level to influence the at least one first control variable, from a start of an operation of the at least one actuator, in order to prevent a faulty activation of the at least one actuator if the at least one selected variable one of assumes a fixedly predefined value and lies within a fixedly predefined range.

2. The method as recited in claim 1, further comprising:

determining one of the fixedly predefined value and the fixedly predefined range on the second level starting from the at least one selected variable.

3. The method as recited in claim 1, further comprising:

suppressing the at least one first control variable during the influencing of the at least one first control variable by the part of the second level.

4. The method as recited in claim 1, further comprising:

feeding back the at least one first control variable to the first level to produce a fed back condition.

5. The method as recited in claim 4, further comprising:

forming on the first level at least one second control variable for controlling an output of the drive unit as a function of the fed back condition of the at least one first control variable.

6. The method as recited in claim 5, wherein the at least one second control variable is formed on the first level for at least partially switching off the output of the drive unit when influencing of the at least one first control variable is detected.

7. The method as recited in claim 5, wherein:

one of a fuel injection, an ignition, and an air supply for at least one cylinder of the drive unit is controlled by the at least one second control variable.

8. The method as recited in claim 1, wherein:

the at least one first control variable is used to control at least one of an opening of an intake valve and an exhaust valve of at least one cylinder of the drive unit.

9. The method as recited in claim 1, further comprising:

deriving the at least one selected variable from a crank angle of at least one cylinder of the drive unit.

10. A device for controlling a drive unit of a vehicle, comprising:

an arrangement provided on a first level and for forming at least one first control variable for controlling at least one actuator of the drive unit;

an arrangement provided on a second level and for verifying in accordance with at least one selected variable whether the forming of the at least one first control variable is correct;

an arrangement provided on the second level and for influencing the at least one first control variable; and an arrangement for comparing the at least one selected variable to one of a fixedly predefined value and a fixedly predefined range to produce a comparison result, wherein:

the arrangement for influencing, from a start of an operation of the at least one actuator, the at least one first control variable as a function of the comparison result in order to prevent a faulty activation of the at least one actuator.

11. A method for controlling a drive unit of a vehicle, comprising:

forming on a first level at least one first control variable for controlling at least one actuator of the drive unit;

verifying on a second level and in accordance with at least one selected variable whether the forming of the at least one first control variable is correct;

causing the second level to influence the at least one first control variable in order to prevent a faulty activation of the at least one actuator if the at least one selected variable one of assumes a fixedly predefined value and lies within a fixedly predefined range; and deriving the at least one selected variable from a crank angle of at least one cylinder of the drive unit.

12. A device for controlling a drive unit of a vehicle, comprising:

an arrangement provided on a first level and for forming at least one first control variable for controlling at least one actuator of the drive unit;

an arrangement provided on a second level and for verifying in accordance with at least one selected variable whether the forming of the at least one first control variable is correct;

an arrangement provided on the second level and for influencing the at least one first control variable;

an arrangement for comparing the at least one selected variable to one of a fixedly predefined value and a fixedly predefined range to produce a comparison result; and an arrangement for deriving the at least one selected variable from a crank angle of at least one cylinder of the drive unit, wherein:

the arrangement for influencing influences the at least one first control variable as a function of the comparison result in order to prevent a faulty activation of the at least one actuator.

* * * * *